US011027943B2

(12) United States Patent
Stanley et al.

(10) Patent No.: US 11,027,943 B2
(45) Date of Patent: Jun. 8, 2021

(54) DESTINATION DISPATCH SECTORING

(71) Applicant: OTIS ELEVATOR COMPANY, Farmington, CT (US)

(72) Inventors: Jannah A. Stanley, Portland, CT (US); Gregory Scharr, Middletown, CT (US); Daniel S. Williams, Southington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 578 days.

(21) Appl. No.: 15/939,860

(22) Filed: Mar. 29, 2018

(65) Prior Publication Data

US 2019/0300327 A1 Oct. 3, 2019

(51) Int. Cl.
*G10H 1/24* (2006.01)
*B66B 1/24* (2006.01)
(Continued)

(52) U.S. Cl.
CPC ..... *B66B 1/2458* (2013.01); *B66B 1/28* (2013.01); *B66B 1/3407* (2013.01); *B66B 1/468* (2013.01); *B66B 2201/226* (2013.01); *B66B 2201/23* (2013.01); *B66B 2201/301* (2013.01); *B66B 2201/302* (2013.01); *B66B 2201/401* (2013.01);
(Continued)

(58) Field of Classification Search
CPC . B66B 1/2458; B66B 1/468; B66B 2201/103; B66B 2201/102; B66B 2201/222; B66B 1/20; B66B 2201/403; B66B 1/2408; B66B 2201/402; B66B 1/52; B66B 2201/243; B66B 2201/223;
(Continued)

(56) References Cited

U.S. PATENT DOCUMENTS 4,492,288 A 1/1985 Schroder
4,804,069 A 2/1989 Bittar et al.
(Continued)

FOREIGN PATENT DOCUMENTS

CN 1819964 A 8/2006
CN 102196981 A 9/2011
(Continued)

OTHER PUBLICATIONS

EP Search Report; EP Application No. 19166356.6; dated Oct. 22, 2019; 11 pages.
(Continued)

*Primary Examiner* — Marlon T Fletcher
(74) *Attorney, Agent, or Firm* — Cantor Colburn LLP

(57) ABSTRACT

A method of operating a building elevator system within a building having a plurality of floors including: controlling a building elevator system comprising a first elevator system having a first elevator car and a second elevator system having a second elevator car; determining one or more sectors for the plurality of floors in response to at least one of a time of day, manual input, a density of the down peak traffic, and whether there is simultaneous up peak or inter-floor traffic, the one or more sectors comprising a first sector having a first plurality of floors and a second sector having a second plurality of floors; assigning the first elevator car to the first sector; and assigning the second elevator car to the second sector.

20 Claims, 3 Drawing Sheets

(51) Int. Cl.
*B66B 1/28* (2006.01)
*B66B 1/34* (2006.01)
*B66B 1/46* (2006.01)

(52) U.S. Cl.
CPC ... *B66B 2201/402* (2013.01); *B66B 2201/403* (2013.01)

(58) Field of Classification Search
CPC . B66B 2201/234; B66B 2201/30; B66B 1/00; E21D 7/02; G08G 1/07
See application file for complete search history.

(56) References Cited

U.S. PATENT DOCUMENTS 4,838,384 A 6/1989 Thangavelu
5,168,133 A 12/1992 Bahjat et al.
5,276,295 A 1/1994 Kameli
5,317,114 A 5/1994 Pullela et al.
5,382,761 A 1/1995 Amano
5,480,006 A 1/1996 Kameli et al.
5,719,360 A * 2/1998 Davis ..... B66B 1/20 187/380
5,883,343 A 3/1999 MacDonald et al.
6,808,049 B2 10/2004 Brand et al.
7,434,665 B2 10/2008 Bahjat et al.
7,921,968 B2 4/2011 Stanley et al.
8,151,943 B2 4/2012 De Groot
2004/0089503 A1 5/2004 Brand et al.
2006/0196734 A1* 9/2006 LaBarre ..... B66B 1/20 187/383
2006/0213727 A1* 9/2006 Hikita ..... B66B 1/2466 187/382
2007/0039785 A1* 2/2007 Smith ..... B66B 1/2466 187/383
2009/0050417 A1 2/2009 De Groot
2012/0000733 A1* 1/2012 Finschi ..... B66B 1/2458 187/382
2012/0175195 A1* 7/2012 Koba ..... B66B 1/2458 187/382
2012/0181115 A1* 7/2012 Koba ..... B66B 13/146 187/247
2013/0264150 A1* 10/2013 Koba ..... B66B 1/2458 187/382
2014/0054116 A1* 2/2014 Wu ..... B66B 3/006 187/392
2014/0124302 A1* 5/2014 Sorsa ..... B66B 1/2408 187/382
2014/0231177 A1* 8/2014 Flynn ..... B66B 1/2458 187/247
2014/0262628 A1* 9/2014 Jacobs ..... B66B 1/2466 187/247
2014/0291077 A1* 10/2014 Suzuki ..... B66B 1/2433 187/382
2015/0158694 A1* 6/2015 Finschi ..... B66B 1/2458 187/247
2015/0203327 A1 7/2015 Appana, Jr.
2018/0022573 A1* 1/2018 Hsu ..... B66B 1/468 187/247
2018/0022574 A1* 1/2018 Pasini ..... B66B 1/2466 187/247
2019/0135579 A1* 5/2019 Siikonen ..... B66B 1/2491
2019/0300327 A1* 10/2019 Stanley ..... B66B 1/28
2019/0300328 A1* 10/2019 Stanley ..... B66B 1/18
2020/0039783 A1* 2/2020 Williams ..... B66B 1/3446
2020/0087105 A1* 3/2020 Pusala ..... B66B 1/468

FOREIGN PATENT DOCUMENTS

DE 102006046062 A1 4/2008
EP 0452225 A2 10/1991
JP H08225257 A 9/1996
JP H11255439 A 9/1999
JP 3448890 B2 9/2003
WO 2015109166 A1 7/2015

OTHER PUBLICATIONS

First Chinese Office Action for Application No. 201910241819.X; Report Issued Date: Mar. 10, 2021; Report Received Date: Mar. 15, 2021; 8 pages.

* cited by examiner

DESTINATION DISPATCH SECTORING

BACKGROUND

The subject matter disclosed herein relates generally to the field of elevator systems, and specifically to a method and apparatus for coordinating the operation of multiple elevator cars.

Commonly, elevator cars are dispatched throughout the overall length of an elevator shaft to service every floor of a building. Providing service to every floor of a building may lead to a multitude of stops at various floors during peak hours of the elevator operations.

BRIEF SUMMARY

According to an embodiment, a method of operating a building elevator system within a building having a plurality of floors is provided. The method including: controlling a building elevator system comprising a first elevator system having a first elevator car and a second elevator system having a second elevator car, wherein the first elevator car and the second elevator car are configured to serve a plurality of floors; determining one or more sectors for the plurality of floors in response to at least one of a time of day, manual input, a density of the down peak traffic, and whether there is simultaneous up peak or inter-floor traffic, the one or more sectors comprising a first sector having a first plurality of floors and a second sector having a second plurality of floors; assigning the first elevator car to the first sector, the first elevator car being configured to transport passengers from the first sector to a first selected floor of the plurality of floors; and assigning the second elevator car to the second sector, the second elevator car being configured to transport passengers from the second sector to a second selected floor of the plurality of floors.

In addition to one or more of the features described herein, or as an alternative, further embodiments may include: receiving an elevator call from a floor of the first plurality of floors within the first sector; and moving the first elevator car to the floor of the first plurality of floors within the first sector.

In addition to one or more of the features described herein, or as an alternative, further embodiments may include: receiving an elevator call from a floor of the second plurality of floors within the second sector; and moving the second elevator car to the floor of the second plurality of floors within the second sector.

In addition to one or more of the features described herein, or as an alternative, further embodiments may include that the second selected floor is the first selected floor.

In addition to one or more of the features described herein, or as an alternative, further embodiments may include that the first selected floor is an exit floor.

In addition to one or more of the features described herein, or as an alternative, further embodiments may include that the second plurality of floors does not include any floors within the first plurality of floors.

In addition to one or more of the features described herein, or as an alternative, further embodiments may include that the second plurality of floors includes at least one floor within the first plurality of floors.

In addition to one or more of the features described herein, or as an alternative, further embodiments may include that the first plurality of floors includes contiguous floors of the plurality of floors.

In addition to one or more of the features described herein, or as an alternative, further embodiments may include that the first plurality of floors includes non-contiguous floors of the plurality of floors.

In addition to one or more of the features described herein, or as an alternative, further embodiments may include: receiving an elevator call from a floor of the first plurality of floors within the first sector; determining that the first elevator car assigned to the first sector is not eligible to be assigned to the elevator call; determining that a second elevator car is eligible to be assigned to the elevator call; and moving the second elevator car to the floor of the first plurality of floors within the first sector.

In addition to one or more of the features described herein, or as an alternative, further embodiments may include that the first elevator car is ineligible due to an opposite stop condition.

In addition to one or more of the features described herein, or as an alternative, further embodiments may include: receiving an elevator call from a floor of the first plurality of floors within the first sector; determining that the first elevator car assigned to the first sector will not arrive at the floor of the first plurality of floors within the first sector within a first selected time period; determining that a second elevator car will arrive at the floor of the first plurality of floors within the first sector within a first selected time period; and moving the second elevator car to the floor of the first plurality of floors within the first sector.

In addition to one or more of the features described herein, or as an alternative, further embodiments may include: moving the first elevator car through the first sector during a single trip; detecting a number of elevator stops made by the first elevator car during the single trip; and extending the first sector by a selected number of floors as the first elevator car moves through the first sector when the number of elevator stops is less than a selected number of elevator stops.

In addition to one or more of the features described herein, or as an alternative, further embodiments may include: moving the first elevator car through the first sector during a single trip; determining a reversal point of the first elevator car; and extending the first sector by a selected number of floors as the first elevator car moves through the first sector in response to the reversal point of the first elevator car.

In addition to one or more of the features described herein, or as an alternative, further embodiments may include that the first elevator car is moving downward through the first sector.

According to another embodiment, a control system of a building elevator system is provided. The control system including: a processor; a memory comprising computer-executable instructions that, when executed by the processor, cause the processor to perform operations. The operations including: controlling a building elevator system comprising a first elevator system having a first elevator car and a second elevator system having a second elevator car, wherein the first elevator car and the second elevator car are configured to serve a plurality of floors; determining one or more sectors for the plurality of floors in response to at least one of a time of day, manual input, a density of the down peak traffic, and whether there is simultaneous up peak or inter-floor traffic, the one or more sectors comprising a first sector having a first plurality of floors and a second sector having a second plurality of floors; assigning the first elevator car to the first sector, the first elevator car being configured to transport passengers from the first sector to a first selected floor of the plurality of floors; and assigning the second elevator car to the second sector, the second elevator car being configured to transport passengers from the second sector to a second selected floor of the plurality of floors.

In addition to one or more of the features described herein, or as an alternative, further embodiments may include that the operations further comprise: receiving an elevator call from a floor of the first plurality of floors within the first sector; and moving the first elevator car to the floor of the first plurality of floors within the first sector.

In addition to one or more of the features described herein, or as an alternative, further embodiments may include that the operations further comprise: receiving an elevator call from a floor of the second plurality of floors within the second sector; and moving the second elevator car to the floor of the second plurality of floors within the second sector.

In addition to one or more of the features described herein, or as an alternative, further embodiments may include that the second selected floor is the first selected floor.

In addition to one or more of the features described herein, or as an alternative, further embodiments may include that the first selected floor is an exit floor.

Technical effects of embodiments of the present disclosure include dividing an elevators operational route into sectors based upon contiguous floors in order to transport passengers from the sector to an exit or other floor.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
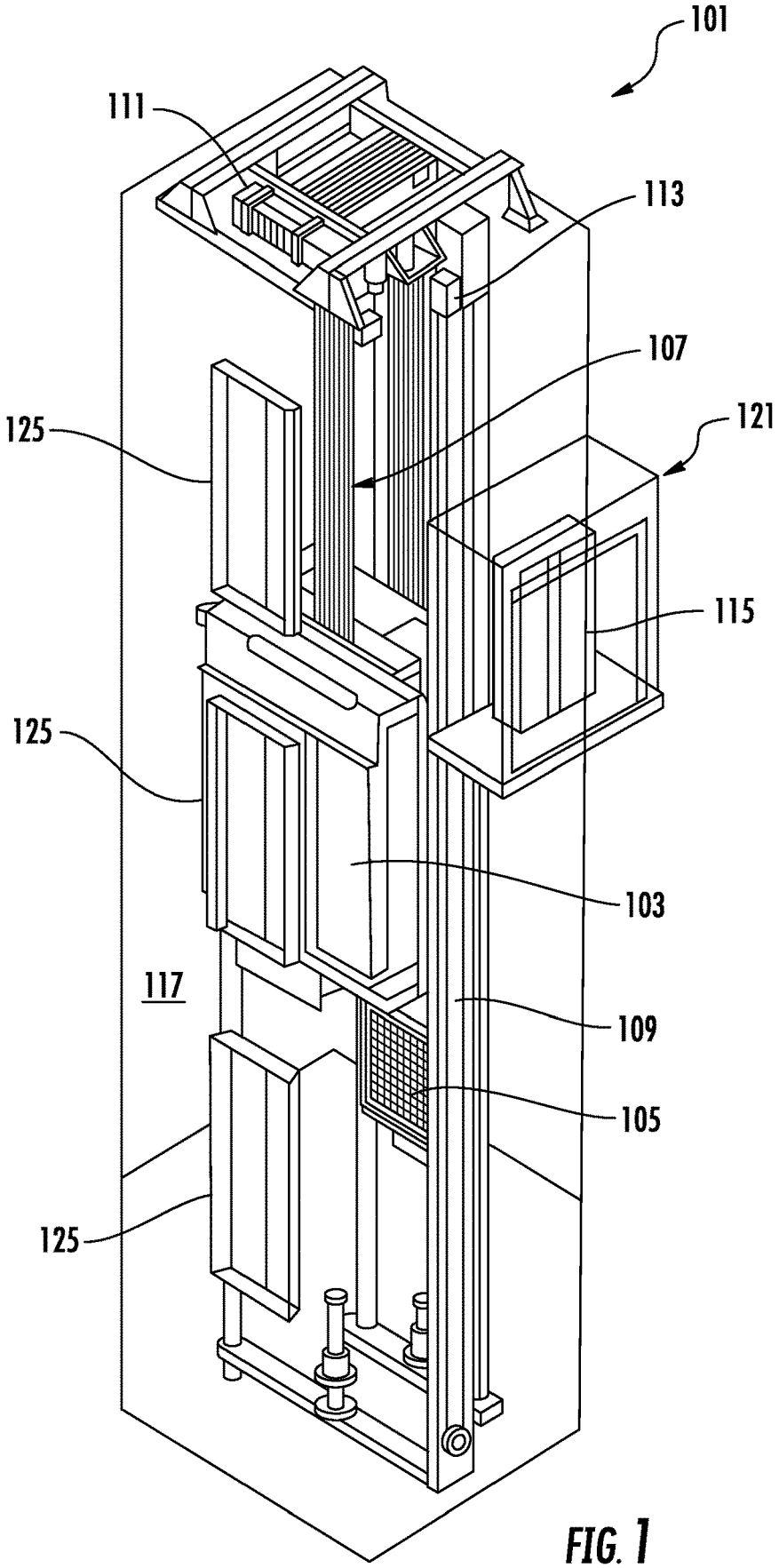
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator hoistway 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator hoistway 117, such as on a support or guide rail, and may be configured to provide position signals related to a position of the elevator car 103 within the elevator hoistway 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator hoistway 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113. When moving up or down within the elevator hoistway 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator hoistway 117.

Although shown and described with a roping system including tension member 107, elevator systems that employ other methods and mechanisms of moving an elevator car within an elevator hoistway may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
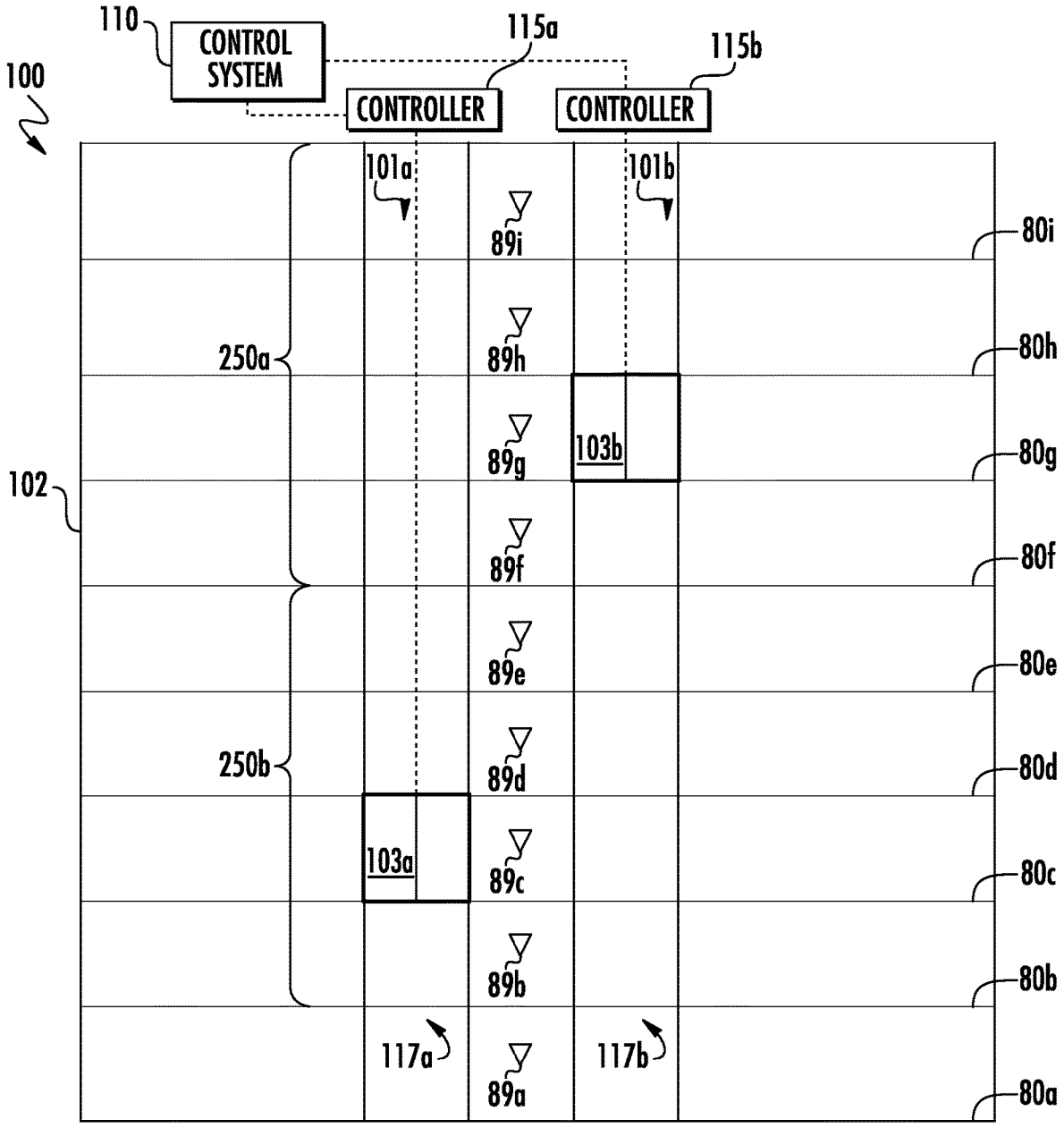
FIG. 2 illustrates a schematic view of a building elevator system, in accordance with an embodiment of the disclosure.

Referring now to FIG. 2 with continued reference to FIG. 1. As seen in FIG. 2, a building elevator system 100 within a building 102 may include multiple different individual elevators systems 101*a*, 101*b*. It is understood that while two elevator systems 101*a*, 101*b* are utilized for exemplary illustration, embodiments disclosed herein may be applied to building elevator systems 100 having one or more elevator systems 101. Each elevator system 101*a*, 101*b* may serve any floor 80*a*-80*i* within the building 102 during normal operation. It is also understood that while nine floors 80*a*-80*i* are utilized for exemplary illustration, embodiments disclosed herein may be applied to building elevator systems 100 having any number of floors.

Each floor 80*a*-80*i* in the building 102 of FIG. 2 may have a destination entry device 89*a*-89*i*. The destination entry device 89*a*-89*i* sends an elevator call to the control system 110 including the source of the elevator call and the destination of the elevator call. The destination entry device 89*a*-89*i* may be a push button and/or a touch screen and may be activated manually or automatically. For example, the elevator call may be sent by an individual manually entering the call via the destination entry device 89*a*-89*i*. The destination entry device 89*a*-89*i* may also be activated to send an elevator call by voice recognition or a passenger detection mechanism in the hallway, such as, for example a weight sensing device, a visual recognition device, and a laser detection device. The destination entry device 89*a*-89*i* may be activated to send an elevator call through an automatic elevator call system that automatically initiates an elevator call when an individual is determined to be moving towards the elevator system in order to call an elevator or when an individual is scheduled to activate the destination entry device 89*a*-89*i*.

The control system 110 is operably connected to the controller 115*a*, 115*b* of each elevator system 101*a*, 101*b*. The controllers 115*a*, 115*b* can be combined, local, remote, cloud, etc. The control system 110 is configured to the control and coordinate operation of multiple elevator system 101*a*, 101*b*. The control system 110 may be an electronic controller including a processor and an associated memory comprising computer-executable instructions that, when executed by the processor, cause the processor to perform various operations. The processor may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be but is not limited to a random access memory (RAM), read only memory (ROM), or other electronic, optical, magnetic or any other computer readable medium.

The control system 110 is configured to organize the elevator floors 80*a*-80*i* into one or more sectors 250*a*, 250*b* and each elevator car 103*a*, 103*b* may be applied to transport individuals in a specific sector 250*a*, 250*b* to selected floor, which may be an exit floor (e.g., floor 80*a*). In one embodiment, each sector 250*a*, 250*b* may be made up of a group of contiguous floors. In another embodiment, each sector 250*a*, 250*b* may be made up of a group of non-contiguous floors. In an example, the control system 110 may sector out the elevator floors 80*b*-80*i* into a first sector 250*a* that includes floors 80*f*-80*i* and a second sector 250*b* that includes floors 80*b*-80*e*. In this example, the first elevator car 103*a* may be assigned to the first sector 250*a* to transport individuals from the floors 80*b*-80*e* to the first floor 80*a* (i.e. exit floor) and a second elevator car 103*b* may be assigned to the second sector 250*b* to transport individuals from the floors 80*f*-80*i* to the first floor 80*a*. One or more elevator cars 103 may be assigned to a single sector 250*a*, 250*b*. Each sector 250*a*, 250*b* may contain a different number of floors 80*a*-80*i*.

The control system 110 can create any number of sectors 250. In an embodiment, the control system 110 may organize the floors 80*a*-80*i* in response to a down peak usage of the building elevator system 100. The control system 110 is configured to create and/or adjust the sectors 250*a*, 250*b* in response to sector parameters including but not limited to a time of day, a density of the down peak traffic, and whether there is simultaneous up peak or inter-floor traffic. The control system 110 is configured to adjust at least one of the number of sectors 250*a*, 250*b*, the number of floors 80*a*-80*i* in each sector 250*a*, 250*b*, and the number of elevator cars 103 assigned to each sector 250*a*, 250*b* in response to the sector parameter listed above. For example, the elevator systems 101 may operate using a single sector 250*a*, 250*b* for all the floors 80*a*-80*i* but then the floors 80*a*-80*i* may be broken up into multiple sectors 250*a*, 250*b* during down peak demand (e.g. at end of the day when everyone is taking the elevator cars 103*a*, 103*b* down and out of the building 102). Advantageously, by organizing the floors 80*a*-80*i* into multiple sectors 250*a*, 250*b*, each elevator car 103 may serve a specific sector and then transport individuals from the sector 250*a*, 250*b* directly to an exit floor, creating an "express path" from the sector 250*a*, 250*b* to the exit floor, thus reducing travel time for each individual. Also advantageously, by organizing the floors 80*a*-80*i* into multiple sectors 250*a*, 250*b*, an elevator car 103 may be moved to a sector 250*a*, 250*b* that is comprised of floors that are low in the building 102 (e.g., second sector 250*b* in FIG. 2), thus reducing the reversal point. The reversal point is a position where the elevator car 103 changes its direction of service (e.g., going from up to down or down to up). For example, elevator cars 103 serving the second sector 250*b* will only have to return to the second sector 250*b* and not to the top of the building 102 after transporting individuals to the exit floor, thus reducing the average reversal point. In an embodiment, a single elevator car 103 may be assigned to different sectors 250*a*, 250*b* for different trips, thus allowing flexible assignment of each elevator car 103. For example, the first elevator car 103*a* may serve a first elevator call in the first sector 250*a* and then serve a second elevator call immediately after the first elevator call in the second sector 250*b*.

The assignment of an elevator car 103 to a sector 250*a*, 250*b* considers the time it would take the elevator car 103 to serve a first elevator call request in the sector 250*a*, 250*b* and the impact of adding the first elevator call to the elevator car 103 on top of other previous elevator calls already committed to be served by the elevator car 103. Once a first elevator car 103*a* is assigned to a first sector 250*a*, a second elevator car 103*b* may be chosen to serve an elevator call in the first sector 250*a* if another parameter such as opposite travel excludes the first elevator car 103*a* from being assigned or current conditions would result in a long wait for the passenger if they are assigned to the first elevator car 103*a* that is assigned to the first sector 250*a*. If a first elevator car 103*a* is assigned to a first sector 250*a* when there is low demand in the first sector 250*a*, then the first sector 250*a* may be extended by one floor at a time as the first elevator car 103*a* moves through the first sector 250*a*. For example, if there is a low number of stops in the first sector 250*a* for the first elevator car 103*a* moving through the first sector 250*a* then the first sector 250*a* may be extended from floors 80*f*-80*i* to floor 80*e*, floor 80*d*, etc. as the first elevator car 103*a* moves downward. In an embodiment, the number of floors that the first sector 250*a* may be extended by may be dependent upon the number of stops made in the first sector 250*a*. For example, the first elevator car 103*a* may be limited to a selected number of stops in the first sector 250*a*. In an embodiment, the number of floors that the first sector 250*a* may be extended by may be dependent upon a reversal point of the first elevator car 103*a*. As mentioned above, the reversal point is the position where the first elevator car 103*a* reverses direction. For example, the sector 250*a*, 250*b* may be extended by the number of floors between the top of the original defined sector 250*a*, 250*b* to the reversal point of the first elevator car 103*a*.

Figure 3:
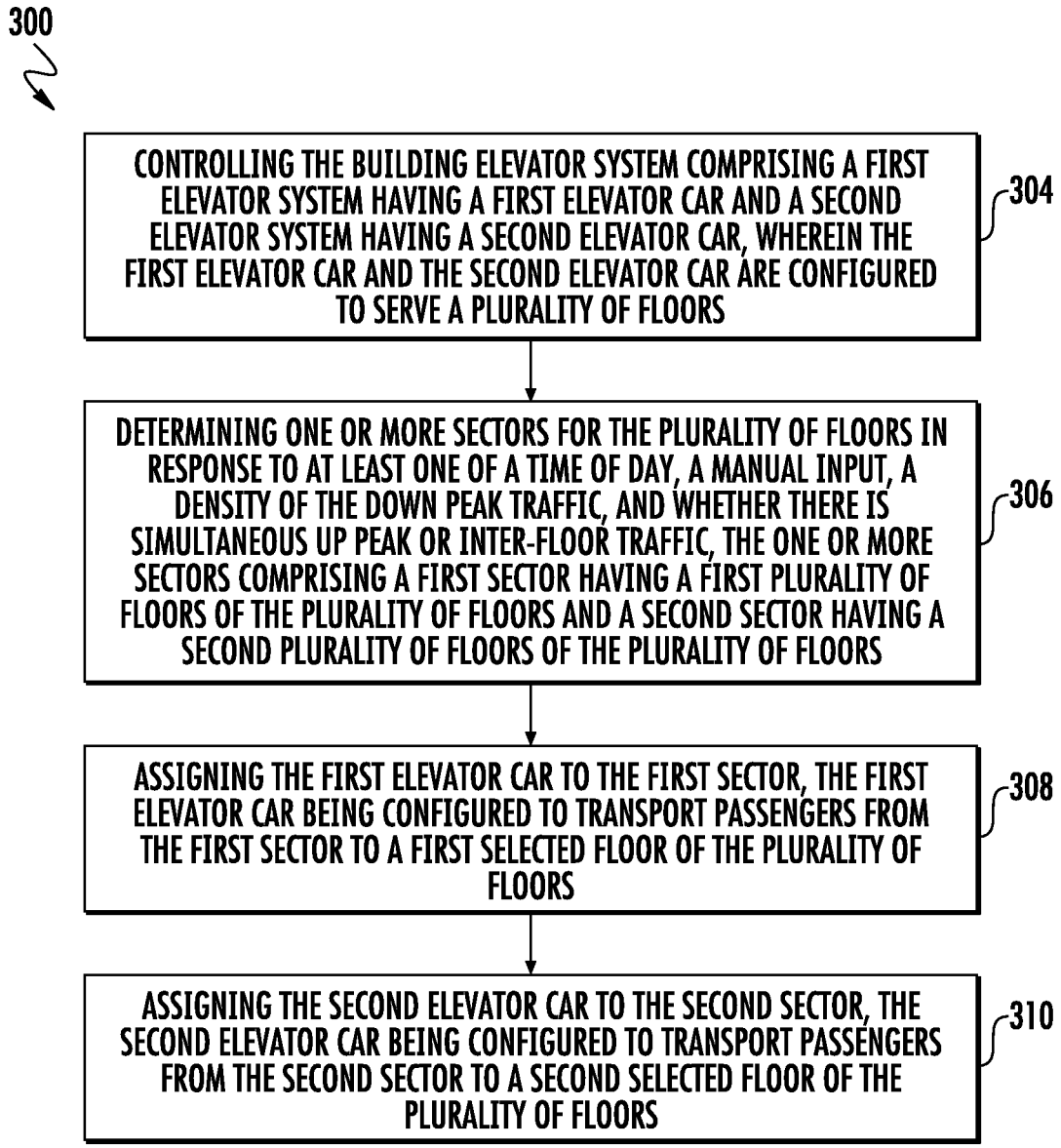
FIG. 3 is a flow chart of method of operating a building elevator system, in accordance with an embodiment of the disclosure.

Referring now to FIG. 3, while referencing components of FIGS. 1 and 2. FIG. 3 shows a flow chart of method 300 of operating a building elevator system 100 within a building 102 having a plurality of floors 80*a*-80*i*, in accordance with an embodiment of the disclosure. At block 304, the building elevator system 100 is under normal operation. Under normal operation, the control system 110 is controlling the first elevator system 101*a* and the second elevator system 101*b*. The exemplary building elevator system 100 comprises a first elevator system 101*a* having a first elevator car 103*a* and a second elevator system 101*b* having a second elevator car 103*b*. The first elevator car 103*a* and the second elevator car 103*b* are configured to serve a plurality of floors 80*a*-80*i*. At block 306, one or more sectors 250*a*, 250*b* for the plurality of floors 80*a*-80*i* are determined in response to at least one of a time of day, a manual input (i.e. from a building manager), a density of the down peak traffic, and whether there is simultaneous up peak or inter-floor traffic. The one or more sectors 250*a*, 250*b* comprising a first sector 250*a* having a first plurality of floors 80*f*-80*i* of the plurality of floors 80*a*-80*i* and a second sector 250*b* having a second plurality of floors 80*b*-80*e* of the plurality of floors 80*a*-80*i*. It is understood that while the exit floor 80*a* in the example illustrated in FIG. 2 is not contained within a sector 250*a*, 250*b* it is serviceable by the each elevator cars 103*a*, 103*b* serving a specific sector 250*a*, 250*b*.

In an embodiment, the second plurality of floors 80*b*-80*e* does not include any floors within the first plurality of floors 80*f*-80*i*. In an embodiment, the first plurality of floors 80*f*-80*i* includes contiguous floors of the plurality of floors 80*a*-80*i*. In an embodiment, the second plurality of floors 80*b*-80*e* includes contiguous floors of the plurality of floors 80*a*-80*i*.

At block 308, the first elevator car 103*a* is assigned to the first sector 250*a* when an elevator call is received from a floor 80*f*-80*i* in the first sector 250*a* requesting transport to the exit floor 80*a*. The first elevator car 103*a* is configured to transport passengers from the first sector 250*a* to a first selected floor of the plurality of floors. When an elevator call is received from a floor of the first plurality of floors 80*f*-80*i* within the first sector 250*a*, the first elevator car 103*a* is moved to the floor of the first plurality of floors 80*f*-80*i* within the first sector 250*a*.

At block 310, the second elevator car 103*b* is assigned to the second sector 250*b* when an elevator call is received from a floor 80*b*-80*e* in the second sector 250*b* requesting transport to the exit floor 80*a*. The second elevator car 103*b* is configured to transport passengers from the second sector 250*b* to a second selected floor of the plurality of floors. When an elevator call is received from a floor of the second plurality of floors 80*b*-80*e* within the second sector 250*b*, the second elevator car 103*b* is moved to the floor of the second plurality of floors 80*b*-80*e* within the second sector 250*b*. In an embodiment, the second selected floor is the first selected floor, thus the first elevator car 103*a* and the second elevator car 103*b* will be transporting passenger to the same floor. In an embodiment, at least one of the first selected floor and the second selected floor may be an exit floor allowing egress from the building 102.

Other elevator cars 103 may be temporarily utilized for serving elevator calls from floors 80*f*-80*i* within the first sector 250*a* if the first elevator car 103*a* will not be able to serve the elevator call within a selected time or the first elevator car 103*a* becomes excluded. The first elevator car 103*a* may become excluded (i.e. ineligible) from serving an elevator call from a floor 80*f*-80*i* within the first sector 250*a* for multiple reasons including but not limited to the first elevator car 103*a* becoming full, the first elevator car 103*a* experiencing an opposite stop condition, etc. In an example of an opposite stop condition, if a first elevator car 103*a* is assigned an elevator call from a floor 80*h* in the first sector 250*a* to the exit floor 80 and is also moving up with a car call to floor 80*g* and then an elevator call is received from floor 80*g*, then the first elevator car 103*a* will be excluded from the elevator call for floor 80*g* and a second elevator car 103*b* may be utilized to serve the elevator call for floor 80*g*. If the second car 103*b* is busy serving elevator calls in the second sector 250*b* then a third elevator car (not shown) from a third elevator system (not shown) may be utilized when the elevator call is received from the floor 80*g* of the first plurality of floors 80*f*-80*i* within the first sector 250*a*.

In a second example, if an elevator call is received from a floor of the first plurality of floors 80*f*-80*i* within the first sector 250*a* and it is determined that the first elevator car 103*a* assigned to the first sector 250*a* will not arrive at the floor of the first plurality of floors 80*f*-80*i* within the first sector 250*a* within a first selected time period and then the second elevator car 103*b* may be utilized when the elevator call is received from the floor of the first plurality of floors 80*f*-80*i* within the first sector 250*a*. If the second car 103*b* is busy serving elevator calls in the second sector 250*b* then a third elevator car (not shown) from a third elevator system (not shown) may be utilized when the elevator call is received from the floor of the first plurality of floors 80*f*-80*i* within the first sector 250*a*

As the elevator car 103 is moving through the sector 250*a*, 250*b* additional floors may be added to the sector 250*a*, 250*b* if the elevator car 103 has not made a selected number of stops in the sector 250*a*, 250*b*. For example, the first elevator car 103*a* may make a selected number of stops as the first elevator car 103*a* is moved through the first sector 250*a*, which is less than the selected number of stops, then the first sector 250*a* may be extended by a selected number of floors until the selected number of stops is reached or until a maximum number of floors are added to the first sector. The maximum number of floors may be the number of floors necessary to extend the first sector 250*a* to the size of half the building 102. If the elevator car is moving downward through the sector 250*a*, 250*b* then floors may be added below the sector 250*a*, 250*b*. In another example, a reversal point for a first elevator car 103 may be determined as the first elevator car 103*a* is moving through the first sector 250*a* during a single trip and then the first sector 250*a* may be extended by a selected number of floors in response to the reversal point of the first elevator car 103*a*.

While the above description has described the flow process of FIG. 3 in a particular order, it should be appreciated that unless otherwise specifically required in the attached claims that the ordering of the steps may be varied.

As described above, embodiments can be in the form of processor-implemented processes and devices for practicing those processes, such as processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes a device for practicing the embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method of operating a building elevator system within a building having a plurality of floors, the method comprising:

controlling a building elevator system comprising a first elevator system having a first elevator car and a second elevator system having a second elevator car, wherein the first elevator car and the second elevator car are configured to serve a plurality of floors;

determining one or more sectors for the plurality of floors in response to at least one of a time of day, manual input, a density of the down peak traffic, and whether there is simultaneous up peak or inter-floor traffic, the one or more sectors comprising a first sector having a first plurality of floors and a second sector having a second plurality of floors;

assigning the first elevator car to the first sector, the first elevator car being configured to transport passengers from the first sector to a first selected floor of the plurality of floors;

assigning the second elevator car to the second sector, the second elevator car being configured to transport passengers from the second sector to a second selected floor of the plurality of floors, receiving an elevator call from a floor of the first plurality of floors within the first sector;

determining that the first elevator car assigned to the first sector will not arrive at the floor of the first plurality of floors within the first sector within a first selected time period;

determining that a second elevator car will arrive at the floor of the first plurality of floors within the first sector within a first selected time period; and moving the second elevator car to the floor of the first plurality of floors within the first sector.

2. The method of claim 1, further comprising:

receiving an elevator call from a floor of the first plurality of floors within the first sector; and moving the first elevator car to the floor of the first plurality of floors within the first sector.

3. The method of claim 2, further comprising:

receiving an elevator call from a floor of the second plurality of floors within the second sector; and moving the second elevator car to the floor of the second plurality of floors within the second sector.

4. The method of claim 1, wherein the second selected floor is the first selected floor.

5. The method of claim 4, wherein the first selected floor is an exit floor.

6. The method of claim 1, wherein the second plurality of floors does not include any floors within the first plurality of floors.

7. The method of claim 1, wherein the second plurality of floors includes at least one floor within the first plurality of floors.

8. The method of claim 1, wherein the first plurality of floors includes contiguous floors of the plurality of floors.

9. The method of claim 1, wherein the first plurality of floors includes non-contiguous floors of the plurality of floors.

10. The method of claim 1, further comprising:

receiving an elevator call from a floor of the first plurality of floors within the first sector;

determining that the first elevator car assigned to the first sector is not eligible to be assigned to the elevator call;

determining that a second elevator car is eligible to be assigned to the elevator call; and moving the second elevator car to the floor of the first plurality of floors within the first sector.

11. The method of claim 10, wherein the first elevator car is ineligible due to an opposite stop condition.

12. The method of claim 1, further comprising:

moving the first elevator car through the first sector during a single trip;

detecting a number of elevator stops made by the first elevator car during the single trip; and extending the first sector by a selected number of floors as the first elevator car moves through the first sector when the number of elevator stops is less than a selected number of elevator stops.

13. The method of claim 1, further comprising:

moving the first elevator car through the first sector during a single trip;

determining a reversal point of the first elevator car; and extending the first sector by a selected number of floors as the first elevator car moves through the first sector in response to the reversal point of the first elevator car.

14. The method of claim 12, wherein the first elevator car is moving downward through the first sector.

15. A control system of a building elevator system comprising:

a processor;

a memory comprising computer-executable instructions that, when executed by the processor, cause the processor to perform operations, the operations comprising:

controlling a building elevator system comprising a first elevator system having a first elevator car and a second elevator system having a second elevator car, wherein the first elevator car and the second elevator car are configured to serve a plurality of floors;

determining one or more sectors for the plurality of floors in response to at least one of a time of day, manual input, a density of the down peak traffic, and whether there is simultaneous up peak or inter-floor traffic, the one or more sectors comprising a first sector having a first plurality of floors and a second sector having a second plurality of floors;

assigning the first elevator car to the first sector, the first elevator car being configured to transport passengers from the first sector to a first selected floor of the plurality of floors;

assigning the second elevator car to the second sector, the second elevator car being configured to transport passengers from the second sector to a second selected floor of the plurality of floors;

receiving an elevator call from a floor of the first plurality of floors within the first sector;

determining that the first elevator car assigned to the first sector will not arrive at the floor of the first plurality of floors within the first sector within a first selected time period;

determining that a second elevator car will arrive at the floor of the first plurality of floors within the first sector within a first selected time period; and moving the second elevator car to the floor of the first plurality of floors within the first sector.

16. The control system of claim 15, wherein the operations further comprise:

receiving an elevator call from a floor of the first plurality of floors within the first sector; and moving the first elevator car to the floor of the first plurality of floors within the first sector.

17. The control system of claim 16, wherein the operations further comprise:

receiving an elevator call from a floor of the second plurality of floors within the second sector; and moving the second elevator car to the floor of the second plurality of floors within the second sector.

18. The control system of claim 15, wherein the second selected floor is the first selected floor.

19. The control system of claim 18, wherein the first selected floor is an exit floor.

20. A method of operating a building elevator system within a building having a plurality of floors, the method comprising:

controlling a building elevator system comprising a first elevator system having a first elevator car and a second elevator system having a second elevator car, wherein the first elevator car and the second elevator car are configured to serve a plurality of floors;

determining one or more sectors for the plurality of floors in response to at least one of a time of day, manual input, a density of the down peak traffic, and whether there is simultaneous up peak or inter-floor traffic, the one or more sectors comprising a first sector having a first plurality of floors and a second sector having a second plurality of floors;

assigning the first elevator car to the first sector, the first elevator car being configured to transport passengers from the first sector to a first selected floor of the plurality of floors;

assigning the second elevator car to the second sector, the second elevator car being configured to transport passengers from the second sector to a second selected floor of the plurality of floors; and moving the first elevator car through the first sector during a single trip, wherein the method further comprises:

detecting a number of elevator stops made by the first elevator car during the single trip and extending the first sector by a selected number of floors as the first elevator car moves through the first sector when the number of elevator stops is less than a selected number of elevator stops; or determining a reversal point of the first elevator car and extending the first sector by a selected number of floors as the first elevator car moves through the first sector in response to the reversal point of the first elevator car.

* * * * *